US009339094B2

(12) United States Patent
Tucker-Skow et al.

(10) Patent No.: US 9,339,094 B2
(45) Date of Patent: May 17, 2016

(54) CREDIT CARD HOLDER AND WALLET

(71) Applicant: OHIO NORTHERN UNIVERSITY, Ada, OH (US)

(72) Inventors: Jeremiah Alexander Tucker-Skow, Tipp City, OH (US); James Robert Stumpf, Tipp City, OH (US)

(73) Assignee: Spectre Wallets, Tipp City, OH (US)

( * ) Notice: Subject to any disclaimer, the term of this patent is extended or adjusted under 35 U.S.C. 154(b) by 0 days.

(21) Appl. No.: 14/444,599

(22) Filed: Jul. 28, 2014

(65) Prior Publication Data

US 2016/0022000 A1 Jan. 28, 2016

(51) Int. Cl.
*A45C 11/18* (2006.01)
*G06K 5/00* (2006.01)

(52) U.S. Cl.
CPC ..... *A45C 11/182* (2013.01); *A45C 2011/186* (2013.01)

(58) Field of Classification Search
CPC .. A45C 11/182; A45C 1/06; A45C 2011/186; G06K 13/08
USPC ..... 235/380
See application file for complete search history.

(56) References Cited

U.S. PATENT DOCUMENTS

| | | | | |
|---|---|---|---|---|
| 2,152,174 | A | 3/1939 | Brunetti | |
| 3,648,832 | A | 3/1972 | Kirshenbaum et al. | |
| 4,202,445 | A * | 5/1980 | Porter | 206/37 |
| 4,697,698 | A | 10/1987 | Holdener | |
| 4,852,727 | A | 8/1989 | Oberle | |
| 4,887,739 | A | 12/1989 | Parker | |
| 6,050,449 | A | 4/2000 | Kanj | |
| 6,089,289 | A | 7/2000 | Florjancic | |
| 6,412,627 | B1 | 7/2002 | Tiscione et al. | |
| 6,581,762 | B2 | 6/2003 | Keough | |
| 6,871,682 | B2 | 3/2005 | Hogganvik | |

(Continued)

FOREIGN PATENT DOCUMENTS

| | | | |
|---|---|---|---|
| CA | 2063599 | A1 | 1/1991 |
| EP | 0287532 | A2 | 10/1988 |

(Continued)

OTHER PUBLICATIONS

Ornes, Stephen, "'Print' Almost Anything", Apr. 28, 2013, Student Science, retrieved on Jun. 11, 2015 from https://student.societyforscience.org/article/%E2%80%98print%E2%80%99-almost-anything.*

(Continued)

*Primary Examiner* — Thien M Le
*Assistant Examiner* — Claude J Brown
(74) *Attorney, Agent, or Firm* — Vorys, Sater, Seymour and Pease LLP; Louis Gubinsky

(57) ABSTRACT

A credit card holder having at least one internal slot for holding a credit card, the internal slot having opposed front and rear plates set at a distance approximately the thickness of a credit card, and also having fixed opposed side guides having credit card side guide surfaces set at a distance from each other of approximately the width of a credit card. A credit card push slide is positioned along an internal width of the slot for engaging the top of a credit card, the slide having opposed credit card slide guide surfaces in alignment with the guide surfaces of the fixed side guides. The slot and the push slide have stop surfaces which cooperate to prevent the slide from completely pushing the card out of the slot.

23 Claims, 10 Drawing Sheets

(56) References Cited

U.S. PATENT DOCUMENTS

| | | | | |
|---|---|---|---|---|
| 7,331,366 | B1 | 2/2008 | Patterson | |
| 8,491,320 | B2 | 7/2013 | Zhang et al. | |
| 8,567,641 | B2 | 10/2013 | Kobayashi | |
| 8,899,411 | B2 * | 12/2014 | Van Geer | 206/39.4 |
| 2003/0057112 | A1 * | 3/2003 | Keough | 206/39.4 |
| 2005/0224149 | A1 * | 10/2005 | Tiscione | 150/148 |
| 2009/0101255 | A1 * | 4/2009 | Long | 150/147 |
| 2010/0038000 | A1 * | 2/2010 | Ho | 150/147 |
| 2012/0067472 | A1 | 3/2012 | Cohen | |
| 2012/0168483 | A1 | 7/2012 | Jambunathan et al. | |
| 2013/0220842 | A1 | 8/2013 | Lazott et al. | |
| 2013/0276943 | A1 | 10/2013 | Minn et al. | |
| 2014/0014676 | A1 * | 1/2014 | Minson et al. | 221/226 |

FOREIGN PATENT DOCUMENTS

| | | | |
|---|---|---|---|
| KR | 20070072050 | A | 7/2007 |
| WO | 2010097342 | A2 | 9/2010 |
| WO | 2013124593 | A1 | 8/2013 |

OTHER PUBLICATIONS

ThinkGreek.com printout "Secrid Aluminum Cardprotector".
Fractalspin.com printout "Credit Card Organizer" pp. 1-3.
SwitchEasy.com printout "Phone card holding mechanism".
The gadgeteer printout Auto Card Manager (ACM) Review 2002.

* cited by examiner

CREDIT CARD HOLDER AND WALLET

BACKGROUND OF THE INVENTION

The present invention relates to a credit and/or debit card holder for securing one or more credit and/or debit cards (hereinafter the term "credit card" is used to encompass not only credit cards but also debit cards and various other cards such as a drivers license, of approximately the same size and approximately of the same thickness as a plastic credit card) with the ability to partially eject a single one of the credit cards for use while retaining the remainder of the card within the holder. In this manner, the magnetic stripe of the credit card can be swiped without the card leaving the holder and then the complete card can be pushed back into the holder. Paper money, other types of cards, etc, are either attached to the exterior of the holder by means of an elastic band or a clip carried by the holder or are held within a holding slot and extracted by a pull or push tab.

The prior art relevant to credit card holders, including wallets which can hold one or more credit cards, describes various devices for securely holding and then ejecting, wholly or partially, one or more credit cards. These prior art devices possess various deficiencies which have precluded their wide-spread acceptance. For example, certain of the prior art devices employ cumbersome trays, with multiple trays used for multiple cards. Other devices employ biasing elements for holding the credit cards within slots, which can cause deterioration of the magnetic stripe due to applied friction. The non-metallic credit card holders are subject to RFID reading whereby a third party can access the information found on the magnetic stripe of a credit or debit card. The present invention provides a credit card holder overcoming these deficiencies of the prior art.

Certain of the prior art is discussed below.

U.S. Pat. No. 6,581,762 describes a credit card holding device in which each card can be pushed partially out of a slot or chamber by push plates connected to push rods. Each chamber is approximately the width of a credit card, but biasing members or springs are used to urge the card against an opposite wall so that the card is held firmly within the slot or chamber.

U.S. Pat. No. 6,089,289 describes a credit card holder for two credit cards in which a rib separates the two cards. Cutouts in a wall of the holder allow the cards to be pushed out of the holder. Inside the holder are protrusions which slightly bend each credit card for preventing the card from falling out of the holder.

EP 0287532 describes a credit card holder for holding and partially ejecting a plurality of cards. The cards are stacked within the container and pushed out in a tiered fashion by a hinged lever. The card holder does not contain individual card chambers nor opposed walls set at a transverse tolerance to prevent cards from falling out. A lid prevents cards from prematurely leaving the holder. Bulges can be positioned along the inner walls of the device for assisting with the prevention of cards falling out even with an open lid.

U.S. Pat. No. 6,050,449, directed to a business card holder and dispenser, states that prior art business card dispensers using springs were too complicated, requiring separate fastening devices, or too hard to assemble into the case, or made the case too large because of the space needed to accommodate the springs.

U.S. Pat. No. 3,648,832 describes a credit card holder for multiple cards in which the holder remains open and cannot close if a card has been removed and not replaced. A billfold or money clip can be secured to an outer surface of the card holder.

U.S. Pat. No. 8,567,641, directed to a business card holder and dispenser, describes different types of springs for providing automatic return of a discharge button.

U.S. Pat. No. 6,412,627 describes a credit card holder in which the cards are prevented from falling out by frictional engagement with a resilient material which may be the case itself, although inclusion of resilient pads parallel to side walls is preferred.

U.S. 2013/0276943 describes a wallet formed of metal or carbon fiber plates with a surrounding elastic strap. Personal items such as paper money, credit cards, etc, can be held by the strap against the outside of one of the exterior plates.

U.S. Pat. No. 4,852,727 describes a multi-credit card holder in which individual trays are spring-loaded and released when a detent is activated for pushing the tray out part way. The spring is behind the tray and pushes it part way out of the device.

ThinkGeek.com advertised an aluminum card protector (Secrid Aluminum Cardprotector) holding up to 6 credit cards which slide out part of the way upon clicking a triggering device so the desired card can be selected. A special coating inside the device prevents the cards from slipping out all of the way. The internal mechanism of the device is not disclosed.

Fractalspin.com advertised a credit card organizer which is an aluminum wallet holding up to six credit cards in individual slots. Switches slide forward and nudge out individual cards which then can be grabbed by the card edge. Precision card spacing prevents scratching. A money clip is provided on the reverse side. The internal mechanism of the device is not disclosed.

SUMMARY OF THE INVENTION

An object of the present invention is to provide a credit card holder capable of automatically and partially ejecting a part of a single credit card and then retracting the ejected card part.

Another object of the present invention is to provide a credit card holder for holding one or more credit cards and capable of automatically and partially ejecting one card at a time for exposing the magnetic stripe of the partially ejected card.

A further object of the present invention is to provide a credit card holder for holding a credit card in a position so that the magnetic stripe of the card is exposed when the card is partially ejected from the holder.

Still a further object of the present invention is to provide a mechanical system for inclusion within a credit card holder whereby a credit card is automatically and partially ejected and then completely pushed back into the holder without damage to the magnetic stripe of the card.

Other objects of the invention will be apparent to the skilled artisan from the detailed description of the invention hereinafter.

In accordance with the present invention, there is provided a credit card holder comprising an internal slot capable of holding a credit card within its opposed side edges; a releasable slide which upon release thereof urges the card out of the slot; a slide stop for preventing the slide from urging the card completely out of the slot and a trigger operatively connected to the slide which when activated releases the slide.

In an embodiment of the invention, there is provided a credit card holder comprising an internal slot formed of opposed front and rear walls for holding the front and rear sides of the card; and opposed fixed side guide surfaces for seating and holding opposed side edges of a credit card therebetween.

In one preferred embodiment of the invention, each of the two fixed opposed side guides, having a side guide surface, is integral with a stop for the releasable card slide, the stop preferably being orthogonal to its integral side guide surface.

In still another embodiment of the invention, the card slide comprises a top card pushing member and side card guides comprising card guide surfaces and stop surfaces, the side card guide stop surfaces being in alignment with the stops orthogonal to the fixed opposed side guide surfaces.

Preferably, the card slide is spring loaded, preferably with the employment of two springs, each connected at one end thereof to a side of the top card pushing member and with the other end of each spring being connected under tension to one of the fixed side guides.

In yet another preferred embodiment of the invention, the trigger is spring loaded, using a compression spring. In this embodiment, the framing member contains a recess into which a slide protrusion fits and is held in place therein by the tensioned or non-tensioned trigger. When the trigger is released, the protrusion exits the recess and the slide is pulled toward the slot entrance by its tensioned side springs. In still another preferred embodiment of the invention, the framing member also contains at least one stop for stopping the slide at a predetermined distance within the slot, thereby preventing the card from completely exiting the slot. This predetermined distance is calculated so as to allow the availability of the magnetic card stripe for swiping within standard credit card swiping devices.

In a further embodiment of the invention, the slide protrusion contains a nose which mates with a finger extension of the trigger, the finger extension holding the slide protrusion in its corresponding slide recess until the trigger is released. Upon release of the trigger releasing mechanism, the trigger is pulled into its tensioned position, and the slide is released to travel as far as engagement of the framing member stop. The nose of the slide protrusion overrides the trigger finger extension when the credit card pushes the slide back into its original position, at which time the trigger extension finger again holds the slide in its locked position. A frame stop prevents the trigger from sliding inwardly beyond the position at which it mates with the slide nose. The trigger can be activated by various means, including a small slidable knob attached to an edge of the slide or integral therewith and extending beyond the body of the device, the knob sliding the trigger to a position in which the lip of the slide is released. Release of the knob allows the spring tensioned trigger to return to its original position for engaging the slide protrusion nose when the card is pushed back into the slot, thereby pushing the card slide into its locked position.

In other preferred embodiments, the holder except for the trigger and card slide is made by 3D plastic printing. In that embodiment, the trigger remains spring loaded and slides laterally a distance as determined by one or more internal slots with fixed projections or posts therein.

In preferred embodiments of the invention, the inventive credit card holder contains a plurality of auto-eject slots for holding a plurality of credit cards, say 2 to 4 credit cards, each within its own slot. In that case, each slot comprises the various elements discussed above, that is, the slide mechanism, the trigger mechanism and the various springs and stops in preferred embodiments. Other embodiments of the invention will be apparent from the Drawing and Detailed Description of the Invention herein.

BRIEF DESCRIPTION OF THE DRAWING

The Drawing illustrates embodiments of the invention.

In FIGS. 1-3 of the Drawing, an internal mechanism for one auto-eject slot is illustrated, it being understood that two or more separated internal mechanisms, for holding a corresponding number of credit cards, and within corresponding slots, can be within the inventive device, as is generally illustrated in FIG. 5 of the Drawing.

DETAILED DESCRIPTION OF THE INVENTION

Figure 1:
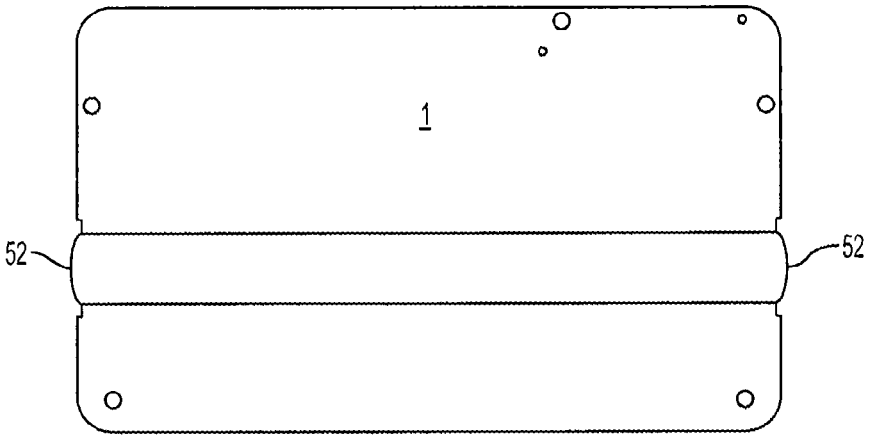
FIGS. 1-3 of the Drawing depict in plan views the various elements that in combination form the internal mechanism of one embodiment of the inventive card holder.
Figure 2:
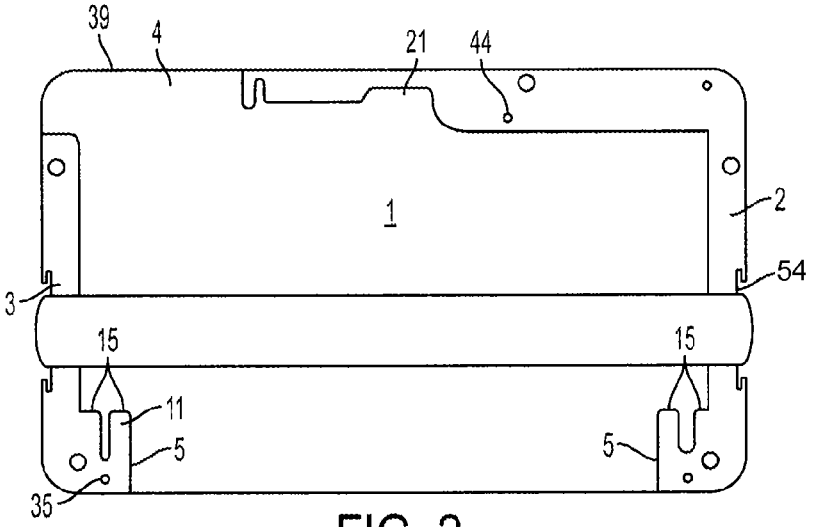
Figure 3:
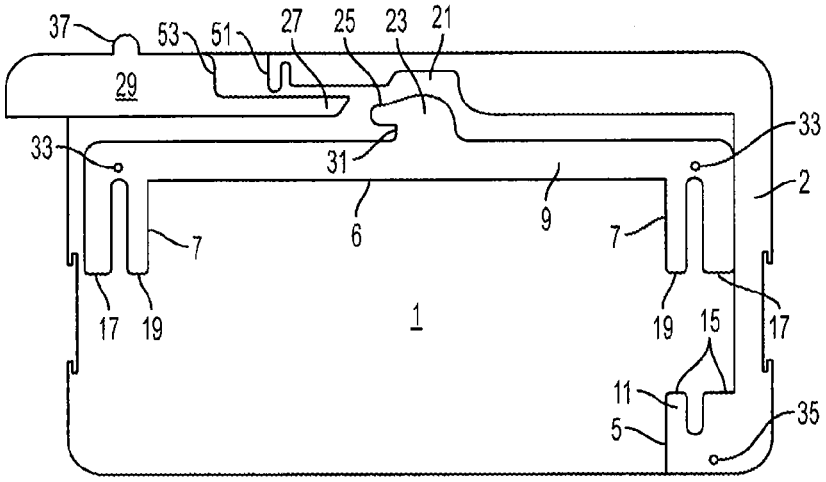

In FIGS. 1-3, element 1 is a front or rear plate of a credit card holding slot. These plates are positioned apart from each other so that a credit card fits snugly therebetween. Framing members 2 and 3 form, respectively, the top and a first side, and the opposed side of a credit card framing member. As depicted, the framing member is in two parts, providing a horizontal gap 4 therebetween. As shown and described below, this gap provides operating room for a trigger, which when engaged, allows a slide to partially push a credit card out of the holder.

The framing member contains credit card guide surfaces 5 at its lower portions. The distances between opposed guide surfaces 5 and between similar opposed guide surfaces 7 on the credit card slide member 9 are set for securely holding a credit card without the need for additional biasing elements. The framing member includes stop surfaces 15 of upwardly extending stops 11. These stop surfaces cooperate, respectively, with protrusions 17 and 19 of the slide member 9 for preventing the slide member from extending beyond the framing member stop surfaces. In this manner, and with the guide surfaces securely holding the credit card, only a portion of the credit card is allowed to extend out of the framing member. The framing member also denotes the overall internal size of the inventive credit card holder. The slide member 9 comprises card pushing surface 6 in addition to its side guide surfaces and associated stop protuberances, shown in the Drawing as orthogonal to the side guide surfaces.

The upper section of the framing member contains an internal centrally located recess 21 having a configuration for accepting and mating with protuberance 23 of the slide member 9. This protuberance has a nose 25 forming recess 31. Nose 25 cooperates with finger extension 27 of trigger 29, which extension fits into the recess 31 formed by the nose for locking the credit card slide member 9 in the recess 21 until the trigger is released.

The framing element comprises a stop 51 which cooperates with surface 53 of the trigger mechanism for preventing the trigger finger extension 27 from exerting undue pressure to the top of the slide member 9.

In the embodiment depicted in FIGS. 1-3, the credit card slide member 9 is under tension when locked in place by the trigger. Tensioning is accomplished by two small springs (not shown) which are attached at their opposite ends to holes 33 in the slide member and holes 35 in the framing member. Of course, the above-described slide stop surfaces prevent the slide member from being pulled by the springs upon release of the trigger beyond the stop surfaces 15 of the framing member.

Figure 4:
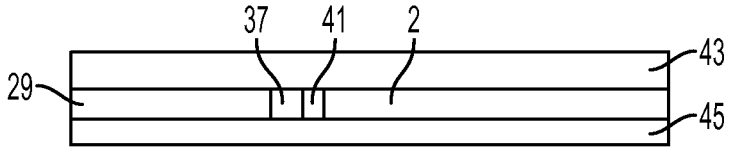
FIG. 4 is a top view of the credit card holder of FIGS. 1-3.
Figure 9:
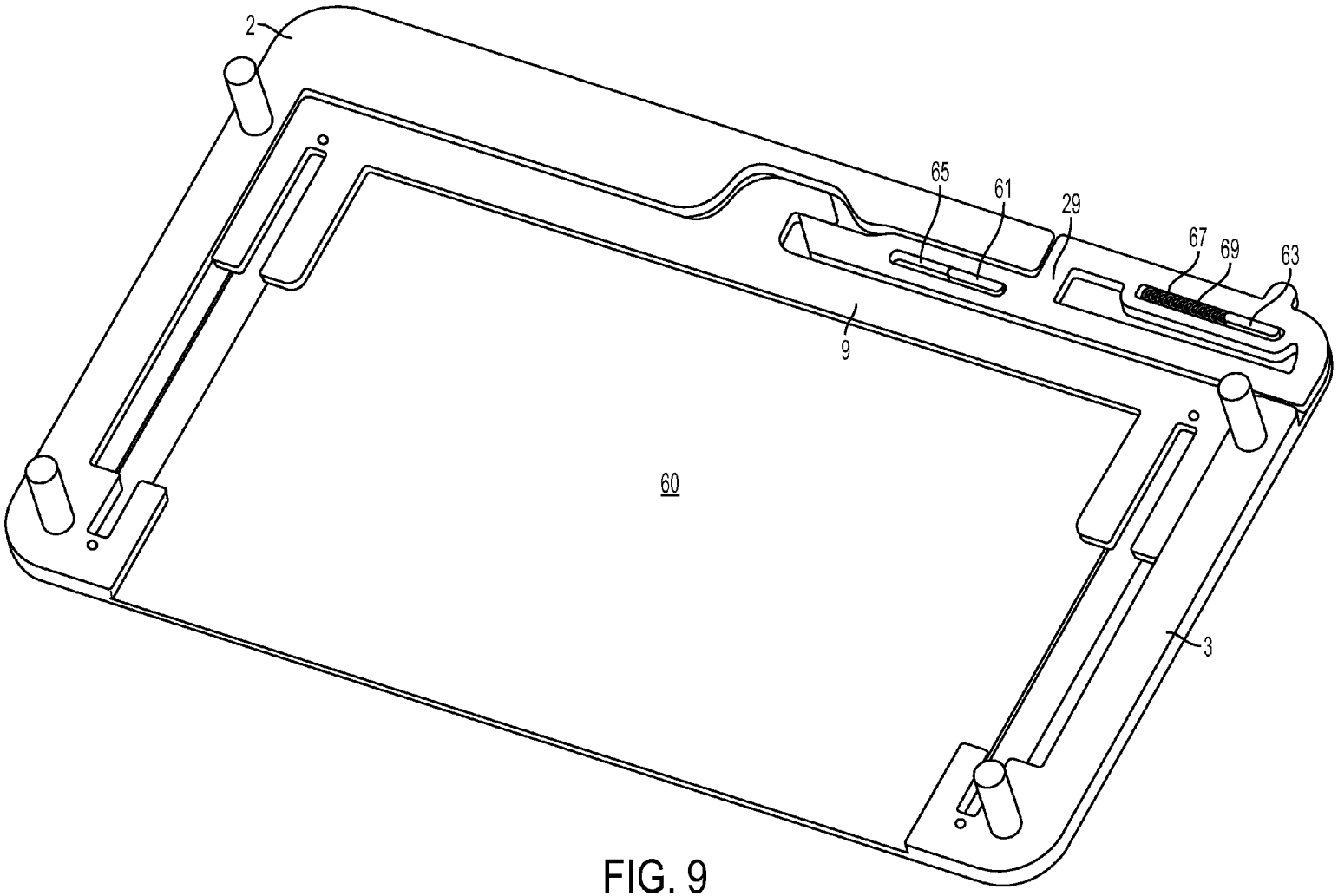
FIG. 9 depicts one half of the inventive wallet as manufactured by 3D plastic printing with the trigger and card push slide made of metal. In this embodiment, the trigger is spring loaded, and slides within a slot with length of movement within the slot limited by a projection or post within the slot.

Trigger 29 also contains knob 37 extending beyond the top surface 39 of the holder and for sliding within a slot 41 formed between base plates 43 and 45 as shown in FIG. 4, which is a top view of the credit card holder and wallet. The trigger is also under tension provided by a compression spring as best seen in FIG. 9 as spring 69. In this manner, when the trigger slides away from the recess 31 and beyond nose 25, the slide member tensioning springs pull the slide member as far as the aforementioned stop surfaces.

Figure 5:
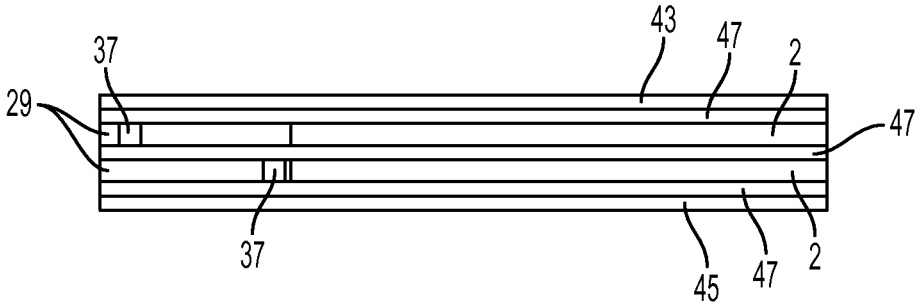
FIG. 5 is a top view of a credit card holder of the invention for holding two credit cards.

When more than one auto-ejectable credit card is to be held within the holder, a divider plate 47 as depicted in FIG. 5 is set between adjacent framing members with associated card slides and triggers for each framing member. For illustrative purposes FIG. 5 is a top view of a credit card holder of the invention for releasably holding two credit cards as seen by the presence of two trigger knobs 37, each within a separate slot formed between a divider plate 47 and an end plate. It is important to note the divider plate is configured so it does not overlap with the magnetic stripe of the inserted credit card. This arrangement helps prevent scratching of the magnetic stripe which might otherwise occur by the stripe rubbing across a larger divider plate when being released from the holder for swiping. With two or more auto-eject card holding slots, divider plate(s) take the place of a front or rear base plate.

Top cover or base plate 43 and bottom base plate 45, which are identical to base plate 1, complete a typical assembly, all of which is held in place by rivets or other connectors extending through the cover plate, framing member, divider plate(s) if present, additional framing members if present and the bottom base plate.

In one embodiment of the invention, additional cards and/or paper money is secured to the holder/wallet by an elastic band 52 extending around the longitudinal surface of the wallet as depicted in FIG. 1. The band fits into slots 54 and is of a length and elasticity for securely holding additional cards and/or paper money against the top and/or bottom outer plate of the holder/wallet.

Figure 6:
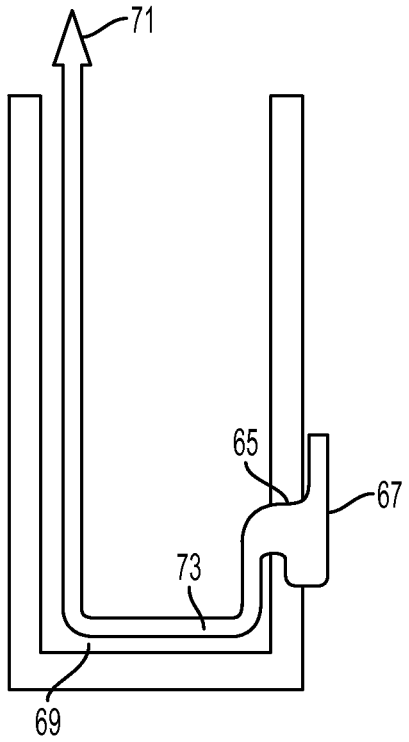
FIG. 6 is a cross-sectional view of a slot for holding additional cards and/or paper money, extractable by a pull tab arrangement.

In another embodiment of the invention, additional credit cards and/or paper money are held within the wallet in a space formed between a base plate and a divider plate. In this embodiment, a pull tab extension sits along the bottom of the space so that when the pull tab is pulled upwardly, the pull tab extension pushes the additional credit cards and/or paper money out of the wallet. In this embodiment, as depicted in cross-section in FIG. 6, the bottom base plate of the wallet is designed to include a tab shaped recess 65 for attaching pull tab 67, which tab does not fit through the recess. An extension of the tab then extends through the base plate, along the bottom of the formed slot space 69, along the opposite side of the space to terminate in the external pull tab section 71. Pulling upwardly on tab 71 raises out of the slot any credit cards or paper money resting on the bottom section 73 of the tab.

Figure 7:
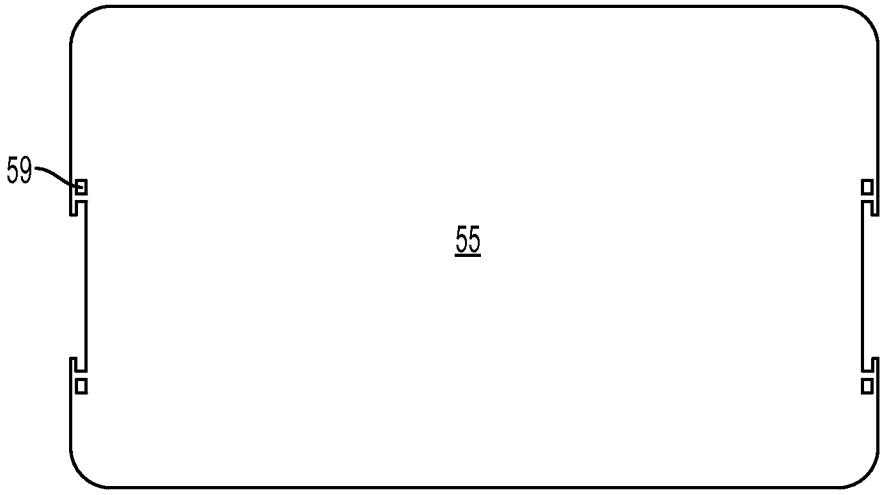
FIGS. 7 and 8 depict attachment means for a color design plate to be attached to a standard end or base plate, including a slot for holding an encircling elastic band.
Figure 8:
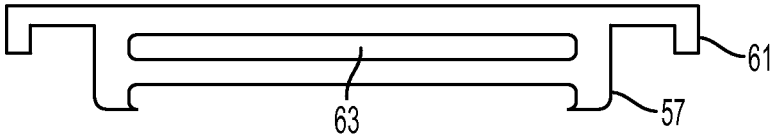

In another embodiment of the invention, different colored face plates 55, as depicted in FIG. 7, can be attached to the top plate of the wallet by the use of two strap clips 57, as depicted in FIG. 8. The face plate and the top plate each contain two sets of aligned holes 59, depicted as rectangular in the Drawing. Legs 61 of the strap clips are of a length and overall dimensions to fit securely into the aligned holes 59, thereby fastening the color face plate to the top plate (which then becomes an inner plate of the wallet). An elastic band, when used, then slides through slot 63 of each strap clip for holding the band against the outer plates of the holder/wallet.

The credit card holder/wallet of the present invention can be made of various materials, many of which will provide RFID protection. For example, all of the parts of the holder/wallet can be made of a metal such as stainless steel or aluminum. When fabricated in this manner, each part is generally separately machined. The wallet also lends itself to 3D plastic printing, during which only the trigger and slide would be separately formed out of plastic or preferably metal. In that case, an additive is added to the outer plastic base plates or provided in an exterior coating for providing RFID protection. The additive might be a chemical compound or metal particles. One advantage of 3D plastic printing is that the wallet/holder can be made in various colors or can be transparent for allowing the holder to view the internal mechanism and its movements. Another advantage is that the plastic interior avoids possible scratching of the magnetic stripe of a credit card, which could happen when rubbing against a metal surface.

FIG. 9 illustrates the internal mechanism of the wallet as made by 3D plastic printing, with the trigger and card push slide being separately manufactured out of metal. Framing elements 2 and 3 are formed by the 3D printing and become integral with the top plate 60 of the holder. Slide member 9 and trigger 29 have been separately fabricated, preferably out of metal, and are inserted into the holder prior to adding a divider plate or bottom plate, not shown. In the embodiment of FIG. 9, trigger slots 65 and 67 determine the distance of lateral movement of the trigger for releasing the card slide member. Since slot 65 in the shown embodiment is the shorter of the two slots, it determines the maximum trigger movement in this instance. Projections or posts 61 and 63, which fit within the slots, lock the trigger in place while allowing sufficient lateral movement for release of the card slide and then seating of the card slide in its recess within the framing element 2. The slide and trigger remain spring loaded in this embodiment.

Figure 10:
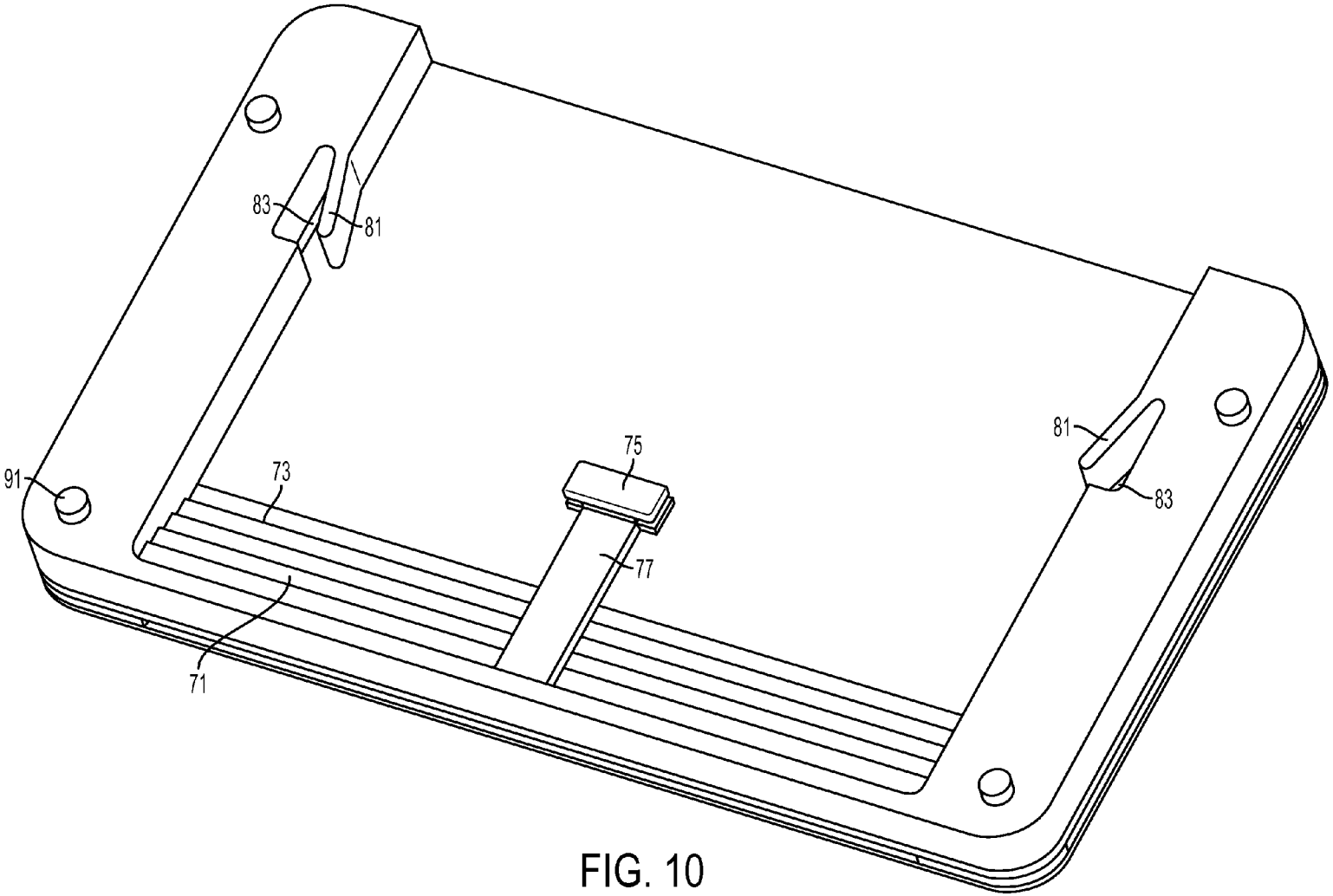
FIGS. 10-13 depict other embodiments for extracting additional, non-auto ejecting, cards from the wallet, involving a slide tab attached to a slidable stepped tray.
Figure 11:
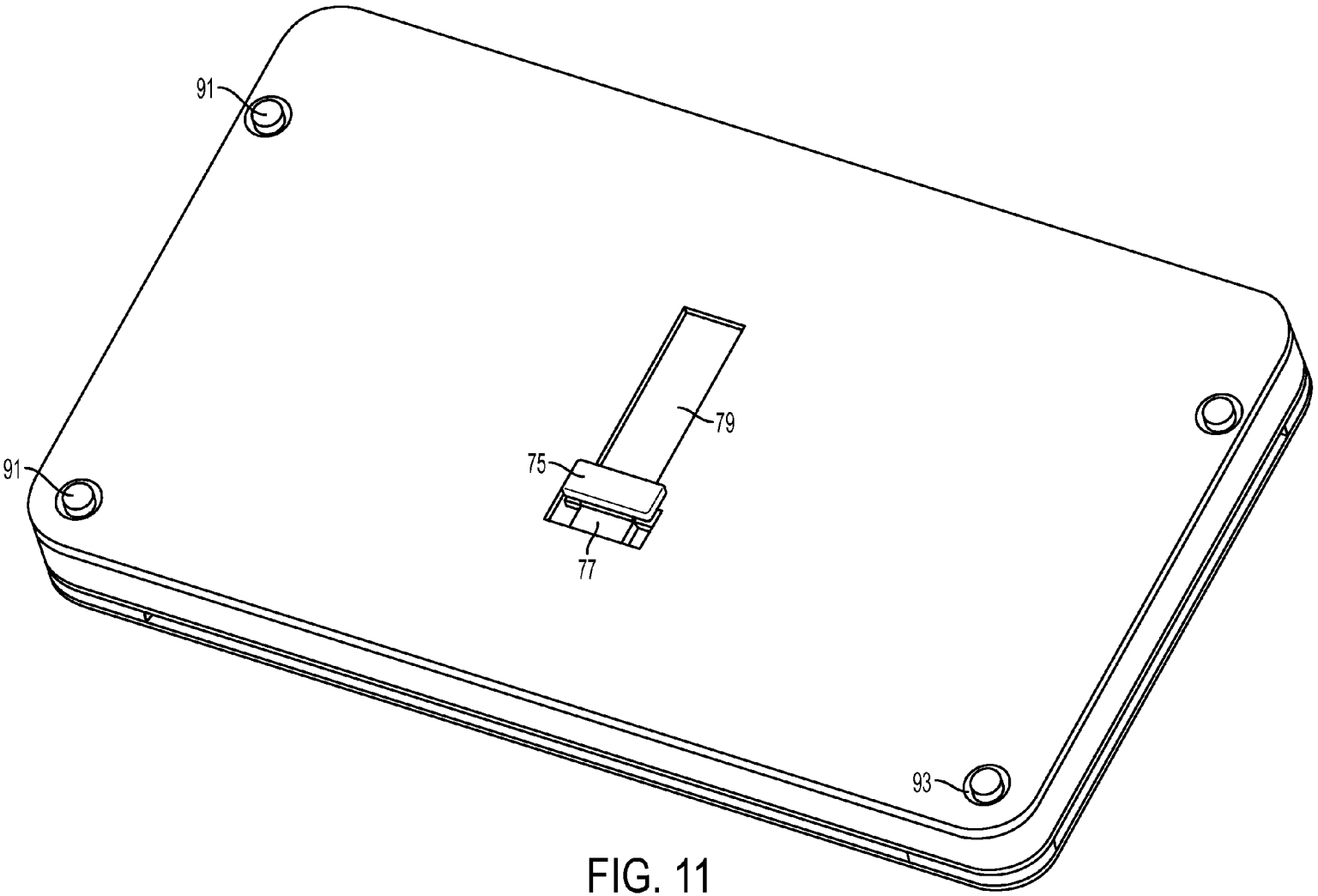

FIGS. 10 and 11 illustrate a second embodiment comprising a tray with steps for storing and retrieving a series of non-auto ejectable cards, in this instance five additional cards, although the number could be varied from one to five additional cards depending upon the number of card holding steps. In FIG. 10, slidable tray 71 comprises five steps 73, each step capable of holding an individual card such as an additional credit card, an awards card, a driver's license, an insurance card and so on. Tab 75 is attached to the slidable tray by attachment 77. As shown in FIG. 11, the tab extends through the bottom plate of the holder and can be reciprocated within slot 79 for pulling one or more cards to an accessible position out of the top of the holder and to returning the slidable tray to its fully retracted position in which no cards are accessible.

Figure 12:
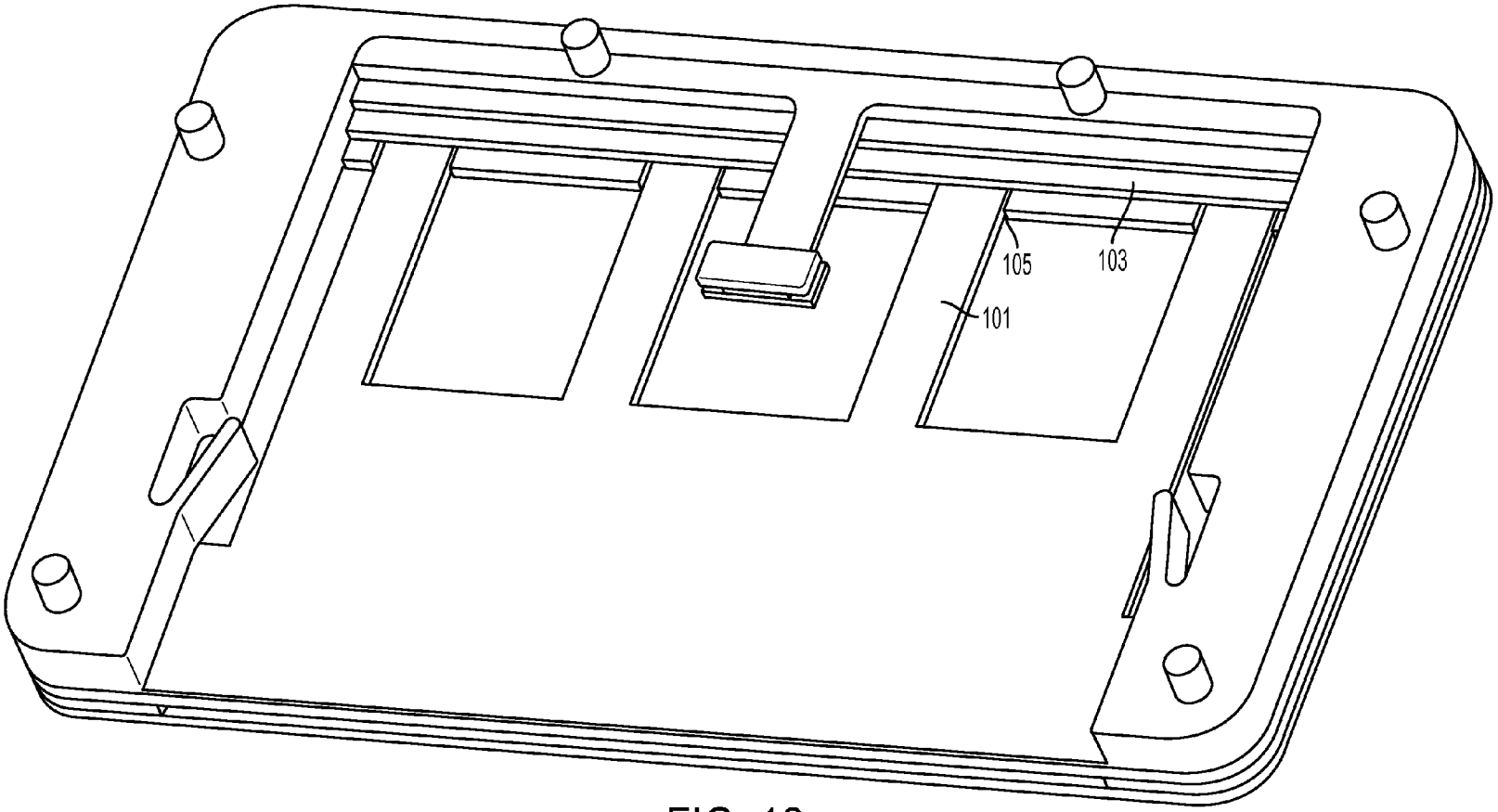
Figure 13:
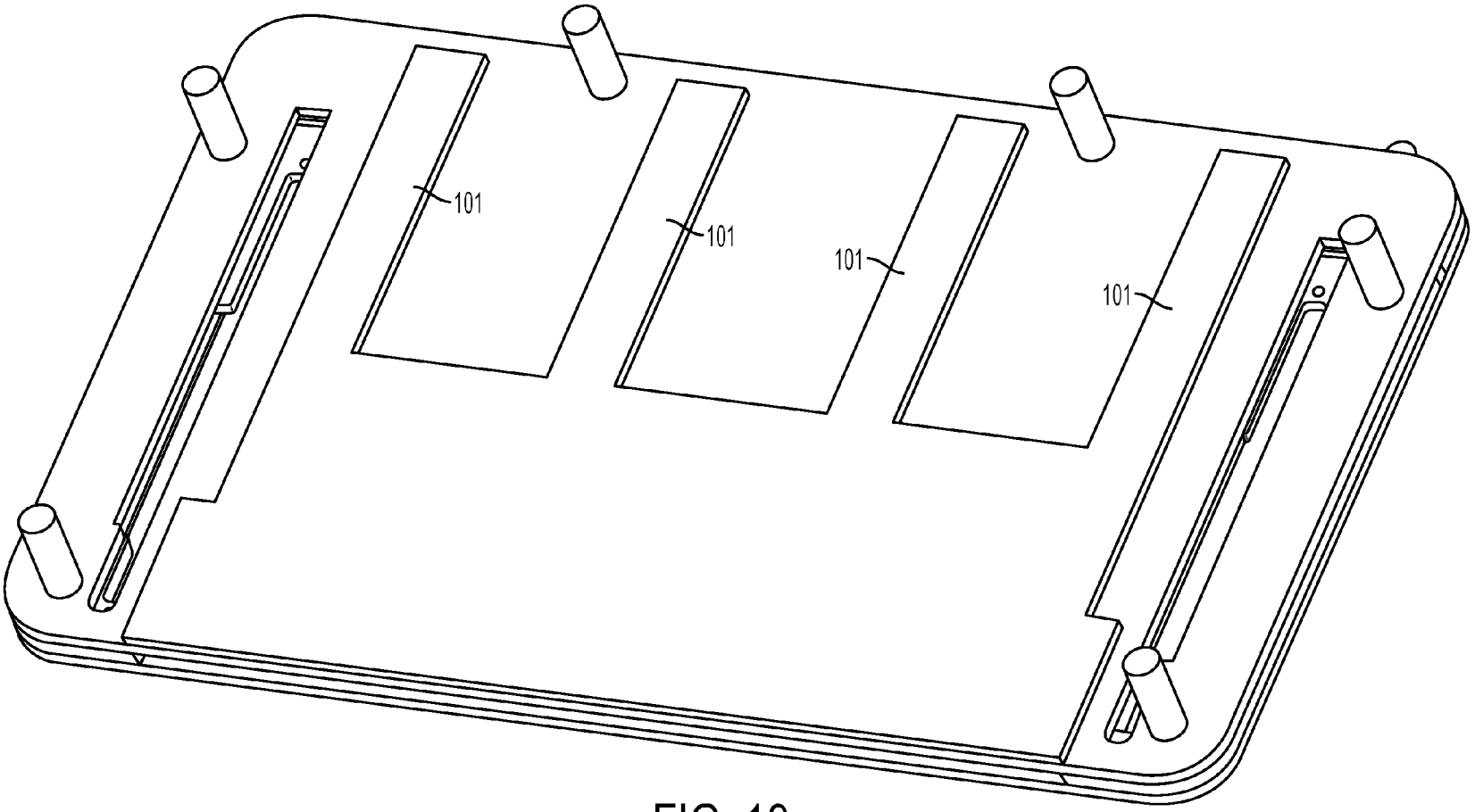

FIGS. 12-13 show a preferred embodiment of the embodiment of FIGS. 10-11. At times with the use of the tray embodiment of FIGS. 10-11, a card could become positioned between the sliding tray and the back or bottom plate of the wallet. To overcome this issue, in FIGS. 12-13, rectangular finger guides 101 are provided beneath the sliding tray. These guide fingers extend into recesses within the bottom most step of the tray and then extend beneath the remainder of the tray, as shown by cut-away FIG. 13. The second step up 103 slides along the top of the guide fingers when the tab is pulled and the guide fingers prevent any cards from becoming lodged beneath the tray. Of course in this embodiment, a card cannot be positioned within the bottom most step having recesses 105 therein.

Credit cards are generally about 8.5 cm by 5.4 cm and approximately 0.91 mm thick. The internal auto-eject slots of the holder are formed of the machined or plastic printed parts for providing these dimensions within very small tolerances, so that a credit card does not inadvertently fall out of its assigned slot. In FIG. 10, there are shown plastic pivots 81 which can pivot in and out of recesses 83. These pivots push against the sides of cards positioned within the slidable tray for preventing them from falling out of the holder due to a slick plastic surface rubbing against a plastic card edge. Similar smaller pivots can be present in the auto-eject slots if desired.

The credit card holder is held together by corner rivets when produced entirely of metal. With plastic 3D printing, the holder includes posts 91 as depicted in FIGS. 9-13. After assembly, the tips of posts 91 are melted to fuse with the bottom or most outer plastic plate of the holder as shown in FIG. 11 by fused areas 93.

Variations of the invention will be apparent to the skilled artisan.

The invention claimed is:

1. A credit card holder comprising at least one internal slot for holding a credit card, the internal slot having opposed front and rear plates set at a distance approximately the thickness of a credit card, the slot having fixed opposed side guides having credit card side guide surfaces set at a distance from each other of approximately the width of a credit card; a credit card push slide positioned along an internal width of the slot for engaging the top of a credit card, the slide having opposed credit card slide guide surfaces in alignment with the guide surfaces of the fixed side guides; the slot and the push slide having stop surfaces which cooperate to prevent the slide from completely pushing the card out of the slot; and wherein the push slide is held in place by a releasable trigger, the trigger having a finger extension which fits into a recess formed by a projection above a card pushing surface of the push slide, whereby the slide is released when the trigger slides out of the recess.

2. The credit card holder of claim 1 wherein the push slide is held under tension in the slot.

3. The credit card holder of claim 2 wherein the push slide is held in the slot by tensioned springs.

4. The credit card holder of claim 1 wherein the cooperating stop surfaces are orthogonal to the fixed opposed side guide surfaces and orthogonal to the card guide surfaces of the push slide.

5. The credit card holder of claim 4 wherein the cooperating stop surfaces are, respectively, integral with the fixed opposed side guides and integral with the push slide.

6. The credit card holder of claim 1 wherein the trigger is held in place under tension.

7. The credit card holder of claim 6 wherein the trigger is held in place by a tensioned spring.

8. The credit card holder of claim 1 containing at least 2 of the credit card holding slots of claim 1.

9. The credit card holder of claim 1 being RFID protected.

10. The credit card holder of claim 1 being formed of metal components.

11. The credit card holder of claim 10 being made of stainless steel and/or aluminum components.

12. The credit card holder of claim 1 being formed of plastic.

13. The credit card holder of claim 12 having been formed by a 3D printing process.

14. The credit card holder of claim 12 being made of transparent plastic.

15. The credit card holder of claim 12 being made of colored plastic.

16. The credit card holder of claim 1 comprising an elastic band surrounding at least a portion of the exterior of the holder for securing additional credit card(s) and/or paper money.

17. The credit card holder of claim 1 comprising an additional slot for holding additional non-auto-eject credit card(s) and/or paper money, the additional cards and/or paper money being pushed out of the slot by an extension of a pull tab.

18. The credit card holder of claim 1 including a framing member containing the opposed fixed side guides, and having a recess into which the projection fits.

19. The credit card holder of claim 18 in which the framing member contains a gap in which the trigger fits.

20. The credit card holder of claim 18 in which the framing member is made of two separate elements with the gap for the trigger therebetween.

21. The credit card holder of claim 1 wherein the trigger is held in place in a non-tensioned state.

22. The credit card holder of claim 1 wherein the released trigger is under tension provided by a compression spring.

23. The credit card holder of claim 1 wherein the credit card holder has opposed inside side walls and the at least one internal slot is narrower than a width between the opposed inside side walls of the credit card holder.

* * * * *